United States Patent [19]

Walker

[11] Patent Number: 4,894,866

[45] Date of Patent: Jan. 23, 1990

[54] BARTENDER'S GLOVE

[76] Inventor: Caroline L. Walker, 2637 2nd Ave., #5, Council Bluffs, Iowa 51501

[21] Appl. No.: 255,354

[22] Filed: Oct. 6, 1988

[51] Int. Cl.[4] ..... A41D 19/00

[52] U.S. Cl. ..... 2/161 R; 2/159/20

[58] Field of Search ..... 2/16, 17, 159, 160, 2/161 A, 161 R, 20, 21, 158, 165, 169, 163; 294/25

[56] References Cited

U.S. PATENT DOCUMENTS

| | | | |
|---|---|---|---|
| 1,673,517 | 6/1928 | Kurz | 2/161 R |
| 2,582,240 | 1/1952 | Dumas | 2/161 R |
| 2,741,880 | 10/1959 | Scherr | 2/159 |
| 3,500,477 | 3/1970 | Meszaras | 2/161 R |
| 4,519,097 | 5/1985 | Chappel, Jr. et al. | 2/161 A X |
| 4,573,220 | 3/1986 | Baker | 2/21 X |
| 4,779,289 | 10/1988 | Prouty | 2/161 R |

FOREIGN PATENT DOCUMENTS

| | | | |
|---|---|---|---|
| 392504 | 5/1933 | United Kingdom | 2/20 |

*Primary Examiner*—Werner H. Schroeder
*Assistant Examiner*—Sara M. Current
*Attorney, Agent, or Firm*—Zarley, McKee, Thomte, Voorhees & Sease

[57] ABSTRACT

A bartender's glove includes a glove having an index finger portion and a thumb portion with truncated ends. The juncture between the index finger and thumb has a leather grip affixed thereto which will frictionally grip a twist-off bottle cap. The glove has a wristband portion comprised of two flaps which are selectively fastenable, so as to make the wristband adjustable to various diameter wrists. The glove is seamed from the index finger diagonally down to the wristband on both the palm side of the glove and the back hand side of the glove.

2 Claims, 2 Drawing Sheets

BARTENDER'S GLOVE

TECHNICAL FIELD

This invention relates generally to gloves, and more particularly to an improved glove adapted for use in opening bottles with twist-off caps.

BACKGROUND OF THE INVENTION

With the advent of twist-off caps on liquor bottles, the bartending vocation has found the need for a device to assist in removing these new type of caps. While overall, the theory of twist-off caps was an improvement over existing caps which required the use of bottle cap openers, the theory has not worked in realistic terms. Twist-off caps can be so tight that they are difficult to open, and can cause blisters on the hand if the action is repeated quite often.

Thus, although twist-off caps were provided for their ease of operation in opening a bottle, a conventional bottle cap opener is many times utilized on such bottles to avoid hurting the hand.

The chief drawback in using a bottle opener is in the fact that chipping of the bottle can occur as the cap is pried off. Another problem in using a bottle opener is in the time spent looking for and obtaining the opener, and the time spent in returning the opener to its proper location.

While other twist-off cap opener devices are available, such as the small sheets of rubber material currently on the market, such devices all suffer the problem of taking time to locate, use and replace, as the conventional pry-type openers.

It is therefore a general object of the present invention to provide an improved bartender's glove.

Another object is to provide a bartender's glove which will assist in removing the twist-off type bottle caps.

Another object of the present invention is to provide a bartender's glove which will grip a bottle cap and prevent contact of the cap directly with the user's hand.

A further object is to provide a bartender's glove which will fit a variety of different hand sizes.

Yet another object of the present invention is to provide a bartender's glove which is submersible in water.

Still another object is to provide a bartender's glove which may be used on either the right or left hand.

Yet a further object of the present invention is to provide a bartender's glove which will conform to the hand during gripping and other hand movements.

Another object is to provide a bartender's glove which is economical to manufacture and refined in appearance.

These and other objects of the present invention will be apparent to those skilled in the art.

SUMMARY OF THE INVENTION

The bartender's glove of this invention includes a glove having an index finger portion and a thumb portion with truncated ends, such that the ends of the index finger and thumb will project from the glove. The juncture between the index finger and thumb has a leather grip affixed thereto which will frictionally grip a twist-off bottle cap. The glove has a wristband portion comprised of two flaps which are selectively fastenable, so as to make the wristband adjustable to various diameter wrists. The glove is seamed from the index finger diagonally down to the wristband on both the palm side of the glove and the back hand side of the glove. This diagonal seam allows the glove to closely conform to the hand during gripping and other movements.

DESCRIPTION OF THE PREFERRED EMBODIMENT

Figure 2:
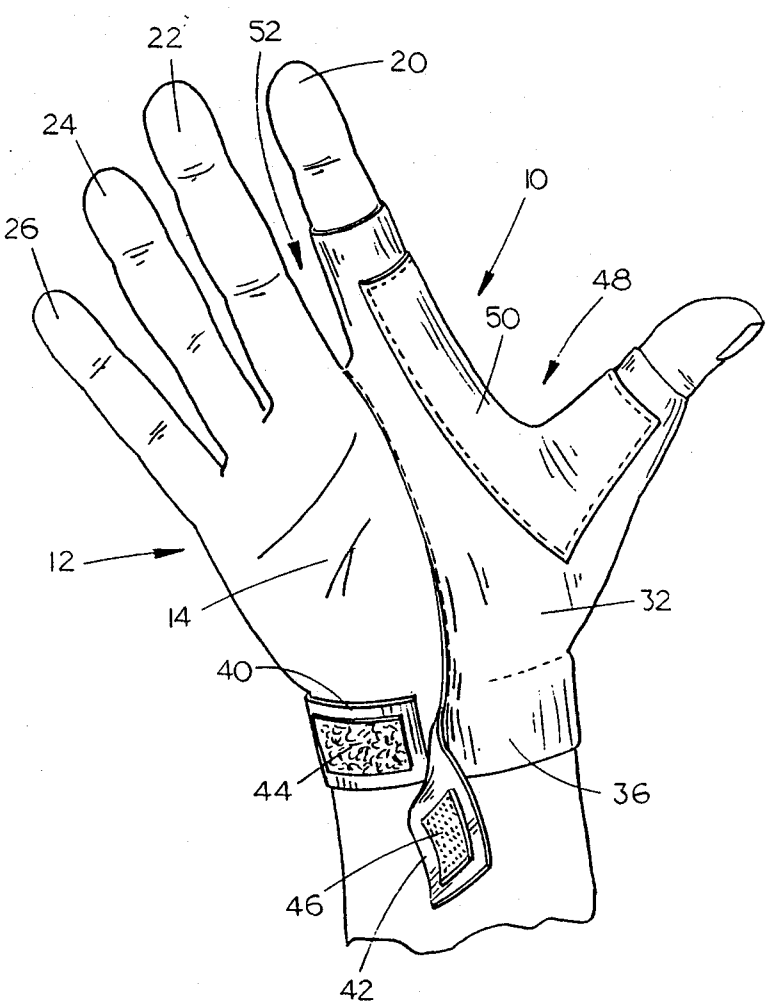
FIG. 2 is a perspective view of the palm side of the glove, showing the wristband fastener.
Figure 1:
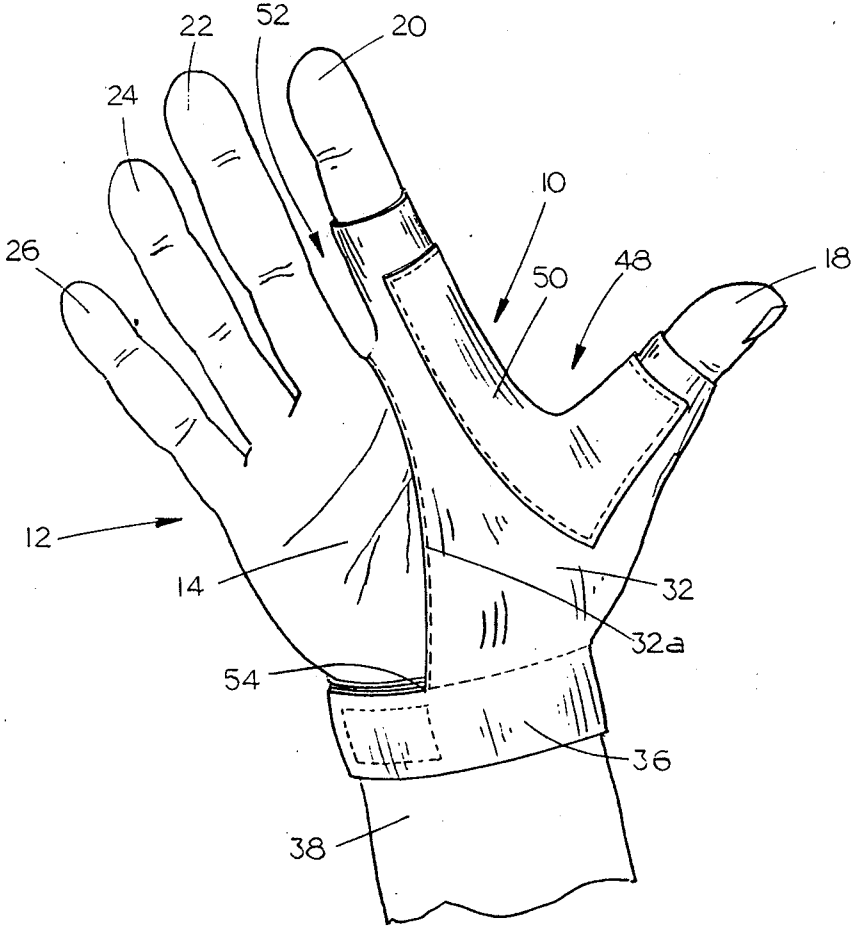
FIG. 1 is a perspective view of the palm side of a hand having the glove of this invention thereon.
Figure 3:
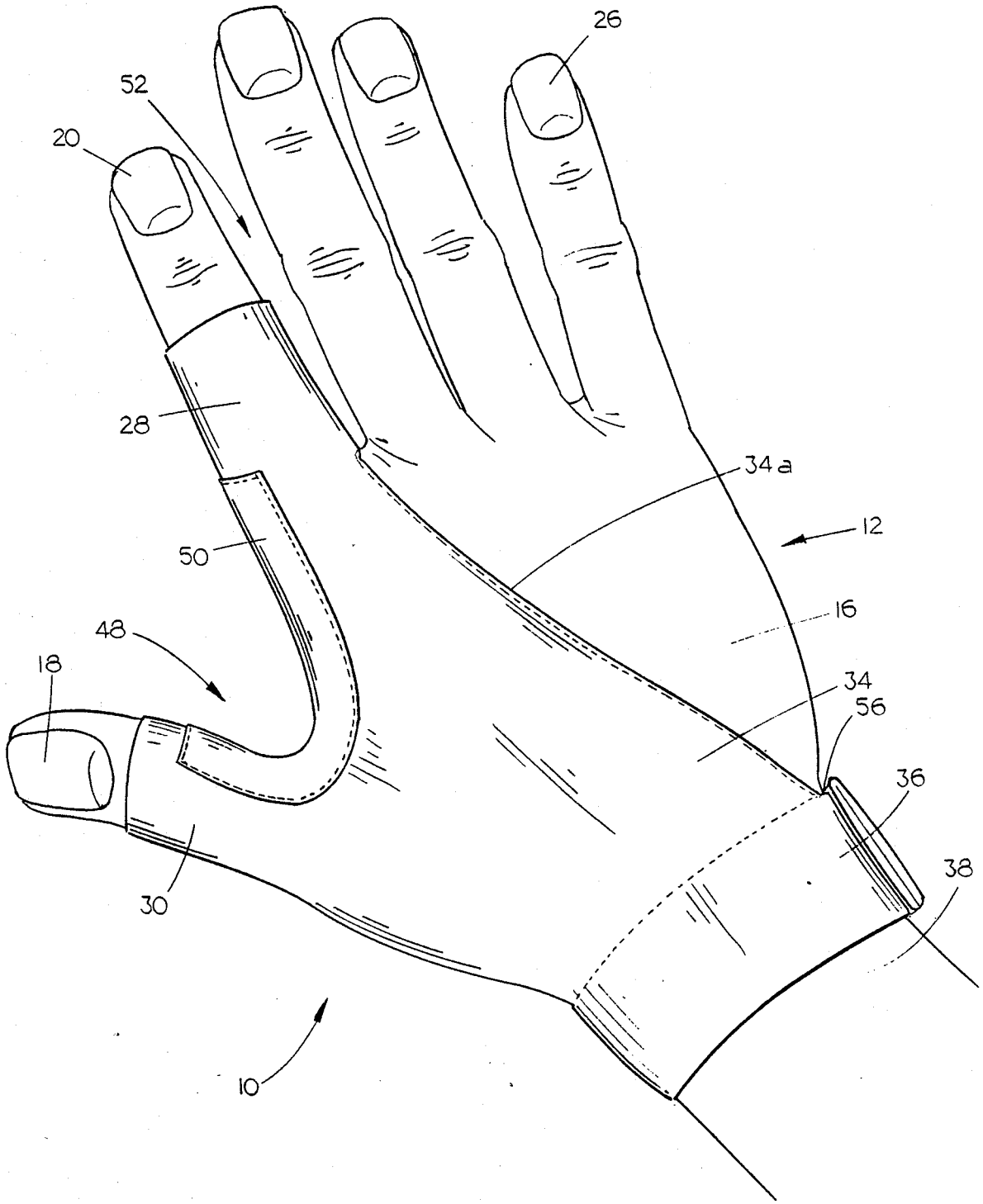
FIG. 3 is a perspective view of the opposite side of the hand of FIG. 1, with the glove thereon.

Referring now to the drawings, in which identical or corresponding parts are identified with the same reference numeral, the bartender's glove of this invention is designated generally at 10 and is shown worn on a hand 12. Hand 12 has a palm side 14, a back side 16, thumb 18, index finger 20 and second, third and fourth fingers 22, 24 and 26.

Glove 10 is formed from a stretchable, water-resistant material with elastic characteristics, which allows the glove to stretch in every direction. One material which, is preferred for this purpose is sold under the brand name LYCRA, and is commonly used in swim suits. Glove 10 includes an index finger portion 28 and a thumb portion 30 which will fit over index finger 20 and thumb 18, respectively. Glove 10 further includes a front portion 32 extending across part of palm 14, and a back portion 34 which extends across a portion of the back 16 of hand 12. Front and back portions 32 and 34 extend to and are connected with a wristband 36, which will fasten about the wrist 38 of the person's hand 12.

Wristband 36 extends laterally beyond the connection with front and back portions 32 and 34 to form a pair of elongated flaps 40 and 42, which will extend around wrist 38 and may be selectively fastened together. The hook portion 44 of a coacting hook and loop fastener is mounted on one face of flap 40, and may be selectively connected to the loop portion 46 of the coacting hook and loop fastener, which is mounted on flap 42. In this way, wristband 36 may be adjusted to the size of the user's wrist.

The ends of finger portion 28 and thumb portion 30 are truncated such that finger 20 and thumb 18 will extend outwardly therefrom. This allows the thumb and fingers to be utilized in picking up coins and similar tasks which could otherwise be hindered by material from the glove 10. The juncture between the index finger 20 and thumb 18 on glove 10 is designated generally at 48, and has a leather grip 50 mounted therealong. Leather grip 50 extends along juncture 48 and onto front portion 2 and back portion 34, as shown in the drawings. A leather material is preferred in this area due to its rugged gripping characteristics and its comfortable feel to the hand.

In order to provide a glove which will conform closely to the hand 12 during movement and gripping, it has been found that a diagonal seam along palm 14 and back 16 prevents any outward "cupping" of the glove. Thus, front portion 32 and back portion 34 include a diagonal seam **32*a* and 34*a*, respectively, which form the outer lateral extent of the glove. Seams 32*a* and 34 extend from the juncture between index finger 20 and finger 22, designated generally at 52, and thence downwardly to wristband 36, as shown in the drawings. It is preferred that seam 32***a* extend from juncture 52 to an intermediate point identified as 54 generally centered on the juncture of palm 14 with wrist 38. It has been found that connecting seam 32*a* at a point more closely adjacent thumb 18 or more distant from thumb 18 would cause "cupping" to occur on front portion 32 when the hand is closed. This cupping will cause the glove to hold water and other objects, and may easily catch on various working materials and utensils.

Similarly, seam 34*a* extends from juncture 52 diagonally across the back 16 of hand 12 to a point designated generally as 56, as shown in the drawings. Point 56 is generally located at the outermost extent distal thumb 18 on the back of hand 16 at its juncture with wrist 38. It has been found that moving point 56 along wrist 38 towards thumb 18 would allow cupping to occur on the back 34 of glove 10.

In use, it can be seen that the twist-off cap of a bottle is gripped by encircling the index finger 20 and thumb 18 therearound with leather grip 50 in direct contact with the bottle cap (not shown). The gripping characteristics of the leather grip 50 allows easy removal of the bottle cap without wear or injury to the hand 12. Since the material of glove 10 and grip 50 are not damaged by water, all tasks performed by the bartender (including washing glasses) may be performed without having to remove the glove 10. Since all of the finger tips and thumb tips are exposed, there is no loss of dexterity in the fingers or thumb in performing any desired task. The hook and loop fasteners 44, 46 on wristband 36 allow the glove to be closely fit to the user's hand, as well as allowing a single size glove to be used for a large variety of hand sizes.

The preferred embodiment of glove 10 includes a second grip portion 50' (not shown) mounted on the interior of glove 10 directly under grip portion 50. The interior grip portion 50' allows the glove to be removed and turned inside out so as to be utilized on the opposite hand. When reversed to the inside-out condition, the grip portion 50' would be utilized in opening a bottle. Similarly, a portion of the glove material may be removed from under grip 50, such that the grip 50 will be exposed if the glove 10 is turned inside-out.

Whereas the invention has been shown and described in connection with the preferred embodiment thereof, it will be understood that many modifications, substitutions and additions may be made which are within the intended broad scope of the appended claims. For example, a variety of different materials may be utilized in forming the glove 10 or grip portion 50. Likewise, a number of different fasteners could be utilized in place of hook and loop fasteners 44, 46. Thus, it can be seen that the invention fulfills at least all of the above stated objectives.

I claim:

1. A bartender's glove, for use in removing twist-off bottle caps, comprising:

a two-fingered glove formed from a stretchable, water-resistant material, said glove having, an index finger portion adapted to receive at least a portion of an index finger, a thumb portion, adapted to receive at least a portion of a thumb, a juncture portion connecting said index finger portion and thumb portion and adapted to cover the juncture between the index finger and the thumb of a hand, a wristband portion adapted to embrace the wrist of the hand, said wristband portion having an adjustable fastener means adapted to selectively adjust the length thereof, a front portion adapted to cover at least a portion of the palm of a hand, said front portion extending from said index finger portion and thumb portion laterally to a front seam, said front seam extending from said index finger portion diagonally to said wristband portion at a location generally centered at the juncture of the palm of a hand and a wrist, said front seam extending at an angle adapted to expose a portion of the palm of the hand and three fingers and adapted to conform said front portion in full contact with the hand during gripping and other movements thereof;

a back portion adapted to cover at least a portion of the back of the hand, said back portion extending from said index finger portion and said thumb portion laterally to a back seam, said back seam extending from said index finger portion diagonally to said wristband portion at a location adjacent the juncture of the back of the hand and wrist which is distal said thumb portion, said back seam extending at an angle adapted to expose a portion of the back of the hand and three fingers and adapted to conform said back portion in full contact with the hand during gripping and other movements thereof; and a flexible gripping portion formed from a leather material and adapted for frictionally engaging a bottle cap, said gripping portion being secured to said juncture portion and extending from said index finger portion to said thumb portion and adapted to cover an area of the glove utilized in gripping a twist-off bottle cap to rotate the bottle cap on a bottle.

2. A bartender's glove, for use in removing twist-off bottle caps, comprising:

a two-fingered glove formed from a stretchable, water-resistant material, said glove having, an index finger portion adapted to receive at least a portion of an index finger, a thumb portion, adapted to receive at least a portion of a thumb, said index finger and thumb portions having truncated ends adapted to allow the ends of an index finger and thumb to project therefrom;

a juncture portion connecting said index finger portion and thumb portion and adapted to cover the juncture between the index finger and the thumb of a hand, a wristband portion adapted to embrace the wrist of the hand, said wristband portion having an adjustable fastener means adapted to selectively adjust the length thereof, a front portion adapted to cover at least a portion of the palm of a hand, said front portion extending from said index finger portion and thumb portion laterally to a front seam, said front seam extending from said index finger portion diagonally to said wristband portion at a location generally centered at the juncture of the palm of a hand and a wrist, said front seam extending at an angle adapted to expose a portion of the palm of the hand and three fingers and adapted to conform said front portion in full contact with the hand during gripping and other movements thereof;

a back portion adapted to cover at least a portion of the back of the hand, said back portion extending from said index finger portion and said thumb portion laterally to a back seam, said back seam extending from said index finger portion diagonally to said wristband portion at a location adjacent the juncture of the back of the hand and wrist which is distal said thumb portion, said back seam extending at an angle adapted to expose a portion of the back of the hand and three fingers and adapted to conform said back portion in full contact with the hand during gripping and other movements thereof; and a flexible gripping portion formed from a leather material and adapted for frictionally engaging a bottle cap, said gripping portion being secured to said juncture portion and extending from said index finger portion to said thumb portion and adapted to cover an area of the glove utilized in gripping a twist-off bottle cap to rotate the bottle cap on a bottle.

* * * * *